United States Patent [19]

Blomberg

[11] Patent Number: 4,656,837

[45] Date of Patent: Apr. 14, 1987

[54] SAFETY ARRANGEMENT IN A GAS OPERATED APPARATUS

[75] Inventor: Peter E. Blomberg, Stockholm, Sweden

[73] Assignee: AB Electrolux, Stockholm, Sweden

[21] Appl. No.: 827,219

[22] Filed: Feb. 5, 1986

Related U.S. Application Data

[60] Continuation-in-part of Ser. No. 769,788, Aug. 26, 1985, abandoned, which is a continuation of Ser. No. 728,442, Apr. 29, 1985, abandoned, which is a continuation of Ser. No. 492,601, May 9, 1983, abandoned, which is a continuation of Ser. No. 195,867, Oct. 10, 1980, abandoned, which is a division of Ser. No. 938,772, Sep. 1, 1978, Pat. No. 4,257,758.

[30] Foreign Application Priority Data

Sep. 8, 1977 [SE] Sweden ..... 7710072

[51] Int. Cl.[4] ..... F25B 27/00

[52] U.S. Cl. ..... 62/236; 62/148; 62/238.1

[58] Field of Search ..... 62/236, 148, 238.1, 62/239; 219/279

[56] References Cited

U.S. PATENT DOCUMENTS

| | | | |
|---|---|---|---|
| 3,093,978 | 6/1963 | Grubb | 62/236 |
| 3,875,369 | 4/1975 | Sellerstam | 62/236 X |
| 3,974,660 | 8/1976 | Farr | 62/236 X |
| 3,976,458 | 8/1976 | Krug | 62/236 X |
| 4,253,311 | 3/1981 | Blomberg | 62/236 X |

*Primary Examiner*—Randall L. Green
*Attorney, Agent, or Firm*—Alfred E. Miller

[57] ABSTRACT

A safety arrangement in a gas-operated apparatus, such as an absorption refrigerator, having a safety device that controls the gas system and, when required, automatically reignites the flame of the gas burner that has become extinguished. The system has a thermostat that is connected to a switch for opening a gas valve when it is necessary to supply gas to the burner. A filament or igniter is also provided which is arranged adjacent to the burner and has a switch which breaks the circuit to the gas valve when a sensor or flame detector at the burner is exposed to a flame.

4 Claims, 4 Drawing Figures

SAFETY ARRANGEMENT IN A GAS OPERATED APPARATUS

This application is a continuation-in-part of application Ser. No. 769,788, filed 8/26/85, abandoned which is a continuation of Ser. No. 728,442, filed 4/29/85, abandoned, which is a continuation of Ser. No. 492,601, filed 5/9/83, abandoned which is a continuation of divisional application Ser. No. 195,867, filed 10/10/80, abandoned, of patent application Ser. No. 938,772, filed 9/1/78, now U.S. Pat. No. 4,257,758, issued Mar. 24, 1981.

The present invention relates to an arrangement in a gas operated apparatus having a thermostatically controlled valve in a gas supply conduit to a burner, and also having a safety device in the supply conduit. The arrangement further relates to an automatic three-way control for a gas-electric refrigerator. Two and three way controls are known for a gas-electric refrigerator which are strictly manually controlled, such as shown in U.S. Pat. No. 3,875,369 to Sellerstam, issued Apr. 1, 1975 and U.S. Pat. No. 3,370,436 to Romanelli. Other patents which show different sources of heat for an absorption refrigerator apparatus are U.S. Pat. Nos. 3,093,978 and 3,284,610, which are manually selectively switched. However, there are several drawbacks to such an arrangement which is manually controlled. The present invention overcomes the aforesaid drawbacks of prior art constructions.

Gas-operated absorption refrigeration apparatus are widely used in trailers, motor homes and boats, in which the operational conditions vary considerably, and interruptions in the operation may occur. For example, a gust of wind can affect the supply of combustion air and the discharge of exhaust gases, so that the gas flame of the burner is extinguished. With respect to these occurrences, a safety device is used which includes a magnetic valve arranged in the gas supply conduit and controlled by a thermocouple at the burner. As long as the gas burns the valve is open. Should the flame extinguish, the valve closes and no gas can escape. To re-establish operation, in addition to the safety device, a valve is provided which is opened manually and is kept open while ignition is attempted by a manually-operated igniter, such as a piezoelectric igniter. As soon as the burner has resumed operation, the safety device becomes active and ensures that gas is supplied to the apparatus, after which the manually operated valve is returned to its closed position.

Considering both the safety of operation and the risk of gas escaping, it is a drawback that the operation has to be supervised by the user in order to re-ignite the burner when necessary. It should also be pointed out that the food products in the refrigerator may spoil if the burner is not re-ignited promptly, and the refrigerator remains operative.

An object of the present invention is to provide a device which controls the gas system and when required automatically re-ignites the flame. A device of this type is known which is intended for gas-operated household equipment, i.e., a water heater with an electronic gas igniter. This igniter can be connected to a battery of low voltage, but a voltage converter results in a very high tension to an ignition electrode at the burner, which is connected to the electric system. Although such an ignition system can solve the above problem it has several serious drawbacks. It is comparatively expensive to produce and is kept in continuous operation. Furthermore, since the known device consumes current all the time, it requires a skilled person in case it becomes necessary to repair the apparatus. It also causes radio interference, and the burner cannot be reignited by hand should some fault occur in the electric system.

In view of the above-recited difficulties of known devices the invention presents another solution without the above drawbacks. It is mainly characterized in that an electric circuit, preferably from a battery, is provided to control the operation of the burner and automatically re-ignite the burner flame, and in that the thermostat is connected to a switch in this circuit, the switch comprising a member for opening the gas valve in the safety device. In addition, an igniter at the burner and a switch are arranged to break the circuit when a flame detector at the burner is exposed to a flame.

The invention will now be described by way of example with reference to two embodiments applied to an absorption refrigerator and shown in the drawings in which.

Figure 1:
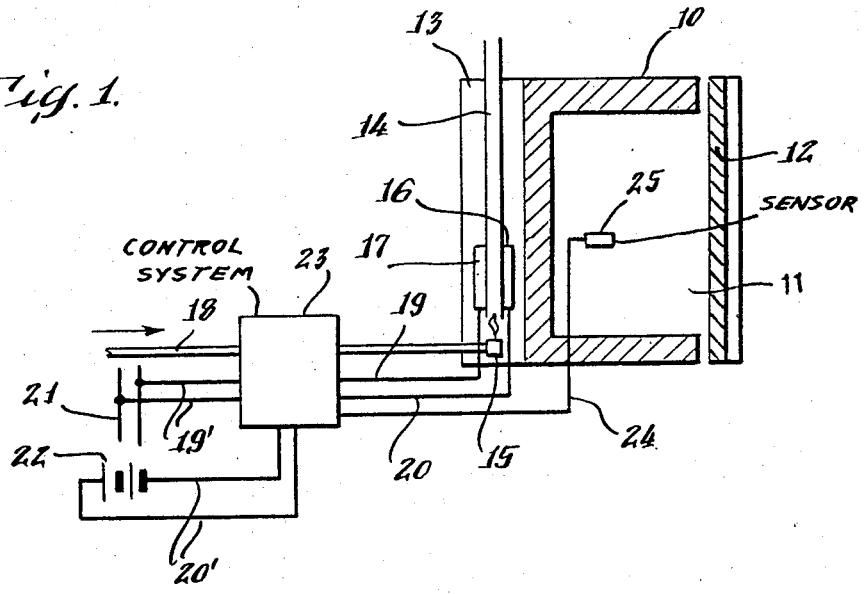
FIG. 1 is a diagrammatic vertical sectional view of a refrigerator operated by an absorption refrigerating apparatus (not shown) to which heat for the operation is supplied alternatively from a gas burner or either of two electric heating cartridges connected to current sources of different types.

FIG. 1 shows a refrigerator 10 with a chamber 11 closed by a door 12. At its rear the refrigerator 10 has an apparatus space 13 containing an absorption refrigerating apparatus (not shown) with evaporator parts (not shown) for cooling the chamber 11. This absorption refrigerating apparatus can be of known type, and since it does not form part of this invention, it is not described herein.

The refrigerating apparatus is operated by heat supplied either from a flue pipe 14, heated by a gas burner 15, or from either of two electric heating cartridges 16, 17. The burner 15 is connected to a gas supply conduit 18, and the heating cartridges 16, 17 are connected to a control system 23 by means of wires 19, 20. The control system is connectible to an electric mains 21 or, respectively, to a battery 22 by wires 19' and 20'. Thus, the refrigerator apparatus may be energized selectively by either A/C, D/C current, or gas, such as propane. The battery 22 can be connected to a charging device, for example a generator. The gas conduit 18 and the electric wires 19, 20 extend through the control system 23, which is i.a. controlled by a thermostat 26 with an impulse conduit 24 to a sensor 25 in the refrigerator chamber 11.

Figure 2:
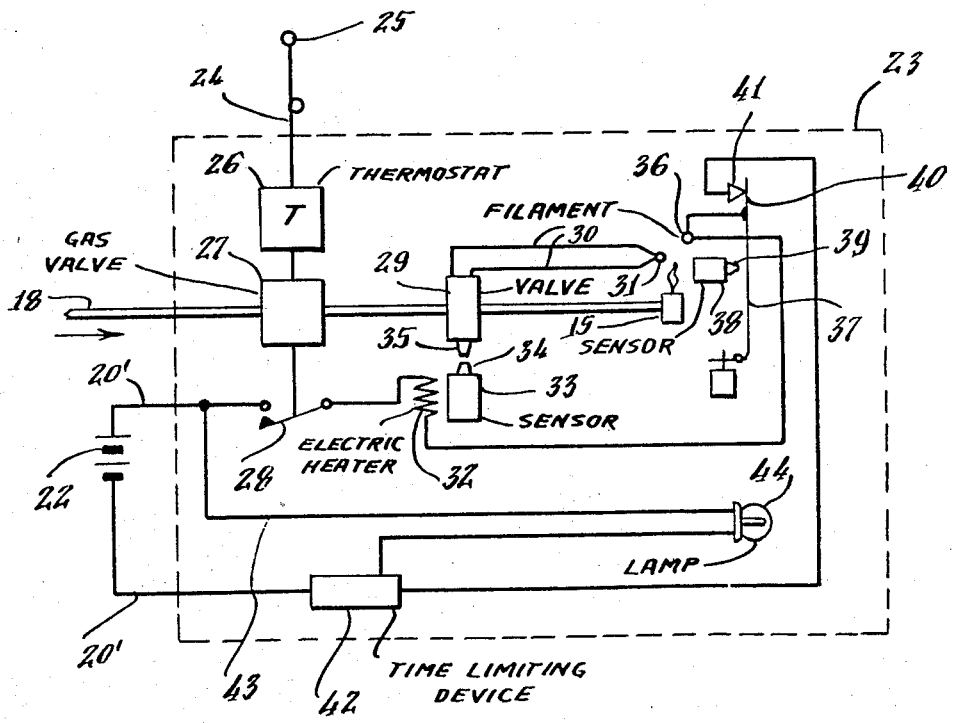
FIG. 2 is a circuit showing gas fittings for the refrigerator of FIG. 1.

The control system 23 of FIG. 1 will now be described. In the first hand, reference is had to FIG. 2, which however for clarity is limited to that part of such a system which is provided for the control and re-ignition of the gas burner in case the flame goes out. In FIG. 2 the control system 23 ls indicated by dashed lines. It also includes the burner 15, which is actually disposed outside the system but for simplicity is shown internally in connection with the control means. The impulse conduit 24 from the sensor 25 goes to the thermostat 26; the gas supply conduit 18 goes through a gas valve 27, controlled by the thermostat 26; and the battery 22 is connected to the control system 23 by a wire 20'. The wire 20' has a switch 28 operated by the thermostat 26. When the temperature in the chamber 11 is above the one set for the thermostat 26, the latter opens the gas valve 27 and closes the circuit through the switch 28. Gas is thus supplied through the conduit 18 to another valve 29, which is a part of a safety device. The valve 29 is magnetically controlled by a current circuit 30 with a thermocouple 31, which in known manner is disposed so as to be affected by the flame of the burner. Should the flame extinguish, the valve 29 closes so that no gas can flow out. However, in accordance with the invention the wire 20' in the control system 23 comprises a device which opens the valve 29 when the thermocouple 31 is cold, and a device for igniting the burner. In the embodi ment shown the opening device is an electric heater 32 arranged to heat a sensor 33 with an activator 34 which operates an opening part 35 of the valve 29. The igniter is a filament 36 suspended on a spring 37, one end of which is fixedly mounted. When the burner is inactive the spring 37 with the filament 36 is in the ignition position, as shown, but after ignition of the flame a sensor 38 with an activator 39 adjacent the flame is heated and moves the free end of the spring away from the burner, so that the filament 36 is moved out of the hot zone. In the embodiment shown in FIG. 2 a part 40 of the spring 37 is included in the electric circuit 20' and in its cold condition bears against a contact 41. When the filament 36 is moved out of the ignition position the circuit is simultaneously opened by the spring part 40 being moved away from the contact 41.

In a situation where an ignition attempt fails, the sensor 38 will not be warm and the spring part 40 will still abut the contact 41 so that the circuit remains closed in spite of repeated attempts to ignite the burner. Should the burner not ignite in spite of repeated attempts, there must be some failure, for example that no gas is supplied to the device. Therefore, the circuit which includes a time limiting device 42 prevents further ignition attempts. This device can be a thermal control of some type having a switch and a bimetallic strip that is heated slowly and breaks the circuit after about 30 seconds. The control system 23 comprises a wire 43 which is connected to the battery 22 and includes a warning means, for example a lamp 44, to clearly indicate that the burner 15 is inactive and the refrigerating apparatus is inoperative. The circuit of the warning lamp is closed by the time limiting device 42 upon interruption of the current in the wire 20'. Under normal conditions the burner 15 is ignited after one or two attempts, and thus the circuit 20' is broken when the spring 37 is moved laterally. Then there is no need for the time limiting device 42 to become active.

Figure 3:
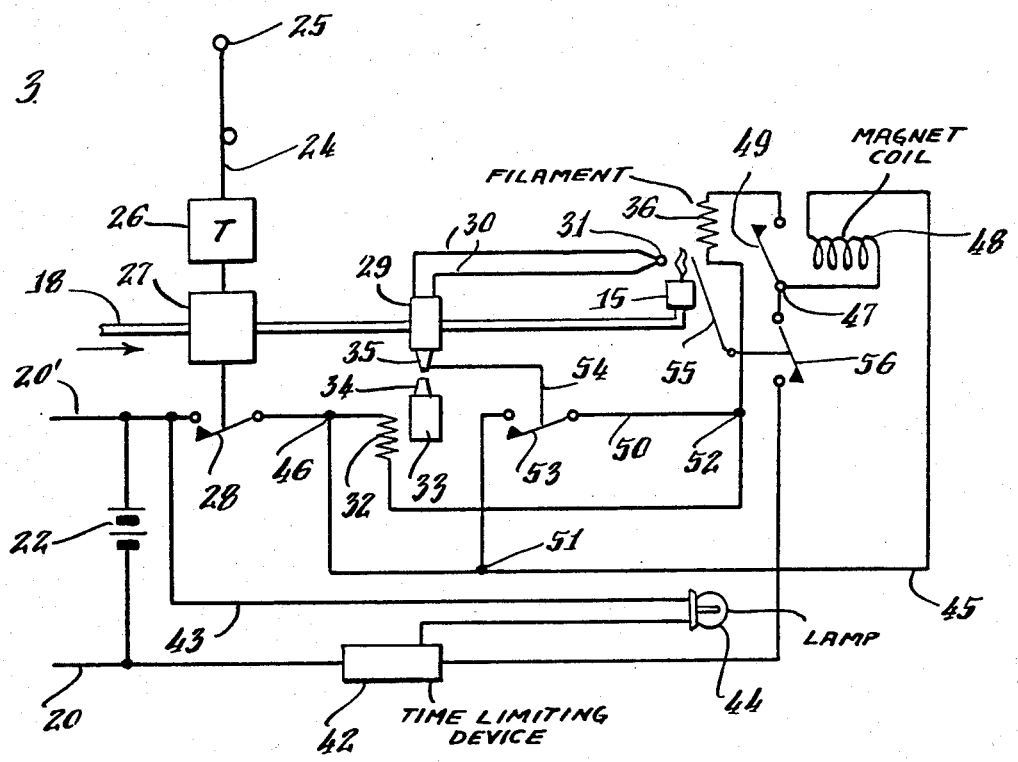
FIG. 3 is a circuit showing a modification of the gas fittings of FIG. 2.

FIG. 3 shows a modification of the control system 23 of FIG. 2. To a large extent the same details are included in FIG. 3 as in FIG. 2, and the same reference numerals apply, up to and including reference numeral 44. Two wires are connected in parallel to the wire 20'. One wire 45 extends from a location 46 to a location 47 and includes a magnet coil 48 arranged to close a switch 49 in the wire 20' through the filament 36. Another wire 50 extends between a location 51 on the wire 45 and a location 52 on the wire 20'. The coil 48 is made to form an undervoltage protection, i.e. it will not pull and close the circuit unless the voltage of the battery is sufficient for the filament to become active. The wire 50 includes a switch 53 having a part 54 mechanically connected to the opening part 35 of the valve 29 in such a manner that the switch 53 is not closed until the opening part 35 has become active, and maintains the valve in an open position. Thus, the filament 36 will not get full voltage until the gas valve has opened. Since the wire 20' between the locations 46 and 52 includes the heater 32 a voltage drop would occur in the circuit through the filament 36 unless the wire 50 were used. The magnet coil 48 can be used also to move the filament between the igniting and the inactive position. A switch 56 controlled by a bimetallic strip 55 near the flame of the burner 15 breaks the current circuit through the filament 36 when the gas has been ignited, and the flame burns.

Figure 4:
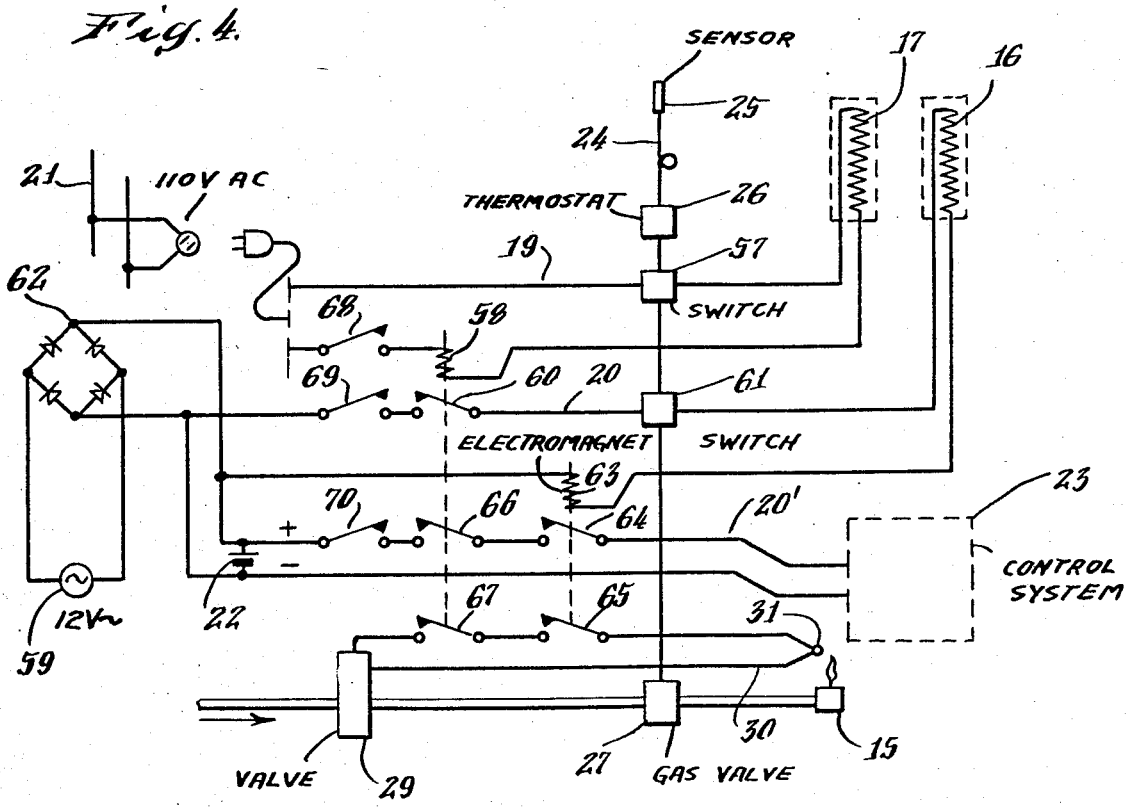
FIG. 4 is a circuit diagram for operation by gas and alternative operation of the refrigerator by either of two electric current sources.

FIG. 4 is a diagrammatic view showing of a gas burner 15 having a control system 23 in connection with means for the supply of heat to a refrigerating apparatus from the burner of either of two different current sources.

If it is possible to connect the wires 19 to a 110 V mains 21, voltage is obtained through a switch 57 controlled by the thermostat 26 of the heating cartridge 17. Simultaneously an electromagnet 58 becomes energized and pulls, and through a switch 60 breaks the current in the wire 20 to a generator 59 for example of a 12 V alternating current source.

If the apparatus is not connected to the mains but the generator 59 is active, heat can be supplied to the refrigerating apparatus through the wire 20 which includes the heating cartridge 16. The circuit includes a rectifier 62, which is controlled by the thermostat 26 by means of a switch 61. Also included in the circuit is an electromagnet 63, which breaks the current in the wire 20' by a switch 64, and the circuit 30 through the valve 29 by a switch 65.

When the wires 19 connected to the mains are under tension, the current in the wire 20' is broken by a switch 66, and the circuit 30 through the gas valve 29 is broken by a switch 67.

If on the contrary, only the battery 22 supplies current, the gas burner 15 will automatically become active and operate while being controlled by the control system in the manner described in connection with FIGS. 2 or 3. Then the battery is only subject to a current drain during ignition.

In each circuit 19, 20 and 20' are respective switches 68, 69, 70, which can be in the switched-in position simultaneously but also permit manual disconnection of a given current source. The switch 69 is preferably included in an ignition look and is dependent on the position of an ignition key. The switches are preferably connected to a control panel. If, for example, a recreational vehicle is moved into a parking place, and the vehicle motor is turned off, a short time will lapse before the wire 19 is connected to the mains. It is, however, unnecessary in the meantime to operate the refrigerator by gas. In that case a button on the control panel is depressed and the switch 70 is set into its off-position.

The safety device described herein effectively controls the gas supply to the burner of the absorption refrigerator whereby, when the flame of the burner is extinguished, it is automatically re-ignited, and the gas supply cut off when the flame detector adjacent to the burner is not exposed to a flame.

The present control arrangement for a heat operated refrigerator includes both energy seeking operations and safety features which will now be described.

The present arrangement is referred to as an automatic energy selector so that when the refrigerator in the mobile home or trailer is first turned on, a circuit arrangement will first search for 110 volts AC. However, if 110 volts is not available because the recreational vehicle is not plugged in, the circuits will then search for 12 volts DC. If 12 volts D.C is not an available power, for example because the motor home or trailer is being towed or the engine is not running, the circuits will then switch the refrigerator over to L.P. gas and cause the burner to be lit. Thus, the automatic energy selector arrangement has the following priorities, first 110 volts AC, second 12 volts D.C. and last, L.P. gas. If the vehicle engine is running, the 12 volt cooling mode is selected, however, when the ignition switch is turned off, the refrigerator will not be in the 12 volt cooling mode, and since the engine is turned off, the system automatically goes into a delay, as described in assignee's prior patent, U.S. Pat. No. 4,236,380, before switching to L.P. gas and igniting, therby preventing dangerous flames and sparks at fuel stops.

When the vehicle is parked, for instance in a camp site, the L.P. gas mode will become active and the burners automatically ignited,. However, if the flame of the burner is extinguished for any reason, such as a dirty burner or a faulty L.P. tank regulator, the system will automatically stop the gas supply to the burner.

Referring to FIG. 4, the system is illustrated having 110 volt AC, 12 volt D.C. or L.P. gas operation, and including a control system 23 that is clearly shown in FIG. 2 of the drawings. A gas supply conduit is referred by the reference numeral 18 in FIG. 3 and is shown again at the bottom of FIG. 4. This conduit supplies gas to the burner 15. An electric heating source 16 is energized by the 12 volt D.C. generator 59. A second electrical heat source 17 is energized by the mains 110 volt AC source 21. It should be noted that the burner 15, as well as the heaters 16 and 17 are intended for alternative operation depending upon the availability of gas or electricity. A gas control circuit is identified by the reference numeral 20' which controls the operation of the burner 15 and automatically re-ignites the burner flame in case the flame becomes extinguished. The thermostat 26 and a first switch 28 is shown in circuit 20' (FIG. 3) whereby the thermostat 26 is connected to the switch, and said circuit includes electric heater 32 arranged to heat a sensor 33, and with an activator 34 which operates on opening part 35 of gas valve 29. This arrangement opens the safety valve 29 in the conduit 18, as shown in FIG. 4, thereby permitting a gas flow to said burner 15. As seen in FIG. 2, an igniter 36 and a flame detector 38 are located adjacent to the burner 15. A bi-metallic switch 40 and 41 in the circuit 20' is arranged to break the circuit when the flame detector 38 is exposed to a flame. The control arrangement further includes electromagnets 58 and 63 which prevent gas burner operation when either the first heat source 16 or second heat source 17 is in operation. Finally, it should be evident that the thermostat 26 acts as a control for the burner 15, and heat sources 16 and 17, whereby the call for heat to the heat operated refrigerator together with the energy selection is made automatic.

While particular embodiments of the invention are herein illustrated and described, it will be understood that changes may be made in the construction and arrangement of elements without departing from the spirit or scope of the invention. Therefore, without limitation in this respect, the invention is defined by the following claims.

What is claimed is:

1. A heat operated refrigerator apparatus which is alternately capable of being driven by a gas burner or one of a plurality of electric heating elements comprising: a gas burner circuit being electrically operated and having a plurality of electrically operated switch members associated with plurality of alternately operated current sources, including alternating current, a D.C. generator and a battery, said switch members being closed in said gas burner circuit to automatically put said burner in operation and to maintain it in operation, and a pair of electromagnetic elements which, when one of said alternate current sources delivers current to one of said electric heating elements operatively connected therewith is arranged to automatically place the burner out of operation by opening one of said electrically operated switch members, and whereby when said battery is the only available current source, said burner circuit is activated, thereby to set the burner in operation.

2. A heat operated refrigerator as claimed in claim 1 wherein one of said heating elements is operable by said generator and the other of said heating element is operable by the alternating current source.

3. A heat operated refrigerator as claimed in claim 1 wherein one of said electromagnetic elements when said alternating current source is connected to one of said heating elements is aranged to automatically disconnect said generator as a current source to the heating element or, if the burner is in operation, to make the same inoperative when said alternating current source is connected to one of said heating elements.

4. A heat operated refrigerator as claimed in claim 3 wherein said generator has a substantially lower voltage than the voltage of said alternating current source.

* * * * *